US008785826B2

(12) United States Patent
Lai et al.

(10) Patent No.: US 8,785,826 B2
(45) Date of Patent: Jul. 22, 2014

(54) EVEN HEATING MICROWAVABLE CONTAINER

(75) Inventors: Laurence M. C. Lai, Mississauga (CA); Neilson Zeng, North York (CA); Bing Liu, Mississauga (CA)

(73) Assignee: Graphic Packaging International, Inc., Atlanta, GA (US)

( * ) Notice: Subject to any disclaimer, the term of this patent is extended or adjusted under 35 U.S.C. 154(b) by 1057 days.

(21) Appl. No.: 12/493,486

(22) Filed: Jun. 29, 2009

(65) Prior Publication Data

US 2009/0294439 A1 Dec. 3, 2009

Related U.S. Application Data

(63) Continuation of application No. PCT/US2008/051056, filed on Jan. 15, 2008.

(60) Provisional application No. 60/881,781, filed on Jan. 22, 2007.

(51) Int. Cl.
*H05B 6/80* (2006.01)
*B65D 81/34* (2006.01)

(52) U.S. Cl.
USPC ..... 219/728; 219/729; 219/730; 426/107; 426/234

(58) Field of Classification Search
USPC ..... 219/730, 725–729, 734, 735; 426/107, 426/113, 234, 241, 243, 118, 122, 124; 229/120.1, 164, 128, 101.4, 242; 220/62; 99/DIG. 14; 206/551
See application file for complete search history.

(56) References Cited

U.S. PATENT DOCUMENTS

| | | | |
|---|---|---|---|
| 3,865,301 | A | 2/1975 | Pothier et al. |
| 4,703,148 | A | 10/1987 | Mikulski |
| 4,775,771 | A | 10/1988 | Pawlowski |
| 4,865,921 | A | 9/1989 | Hollenberg |
| 4,890,439 | A | 1/1990 | Smart |
| 4,927,991 | A | 5/1990 | Wendt et al. |
| 4,936,935 | A | 6/1990 | Beckett |
| 4,963,424 | A | 10/1990 | Beckett |
| 4,972,059 | A | 11/1990 | Wendt et al. |
| 5,039,364 | A | 8/1991 | Beckett |
| 5,117,078 | A | 5/1992 | Beckett |

(Continued)

FOREIGN PATENT DOCUMENTS

| | | | |
|---|---|---|---|
| EP | 0382399 | A2 | 8/1990 |
| JP | 2005-211090 | A | 8/1993 |

(Continued)

OTHER PUBLICATIONS

European Search Report for EP 12 00 0101 dated Apr. 16, 2012.

(Continued)

*Primary Examiner* — Quang Van
(74) *Attorney, Agent, or Firm* — Womble Carlyle Sandridge & Rice, LLP

(57) ABSTRACT

A construct for heating a food item in a microwave oven includes a base, a wall extending upwardly from the base, a microwave energy shielding element overlying at least a portion of the wall, and a microwave energy diffusing element circumscribed by the microwave energy shielding element. The microwave energy diffusing element includes a plurality of microwave energy reflective elements within a microwave energy transparent area.

33 Claims, 4 Drawing Sheets

(56) References Cited

U.S. PATENT DOCUMENTS

| | | | | |
|---|---|---|---|---|
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,410,135 | A | 4/1995 | Pollart | |
| 5,424,517 | A | 6/1995 | Habeger | |
| 5,519,195 | A | 5/1996 | Keefer | |
| 5,593,610 | A | 1/1997 | Minerich | |
| 5,628,921 | A | 5/1997 | Beckett | |
| 5,672,407 | A | 9/1997 | Beckett | |
| 5,698,127 | A | 12/1997 | Lai et al. | |
| 5,759,422 | A | 6/1998 | Schmelzer | |
| 5,800,724 | A | 9/1998 | Habeger | |
| 6,102,281 | A | 8/2000 | Lafferty et al. | |
| 6,114,679 | A | 9/2000 | Lai | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,717,121 | B2 * | 4/2004 | Zeng et al. | 219/730 |
| 6,765,182 | B2 | 7/2004 | Cole | |
| 7,476,830 | B2 * | 1/2009 | Middleton et al. | 219/729 |
| 2003/0085223 | A1 | 5/2003 | Zeng et al. | |
| 2003/0111463 | A1 * | 6/2003 | Lai | 219/728 |
| 2006/0049190 | A1 | 3/2006 | Middleton | |
| 2007/0215611 | A1 | 9/2007 | O'Hagan | |
| 2009/0223951 | A1 | 9/2009 | Lai et al. | |
| 2010/0006566 | A1 | 1/2010 | Lai et al. | |

FOREIGN PATENT DOCUMENTS

| | | | |
|---|---|---|---|
| JP | 10-72068 | | 3/1998 |
| JP | 2000-018595 | A | 1/2000 |
| JP | 2001-278362 | A | 10/2001 |
| JP | 2005512902 | | 5/2005 |
| WO | 9111893 | A1 | 8/1991 |
| WO | 03053106 | A1 | 6/2003 |
| WO | 2006110685 | A2 | 10/2006 |
| WO | WO 2007/106353 | A2 | 9/2007 |
| WO | WO 2007/113545 | A1 | 10/2007 |
| WO | WO 2008/091760 | | 7/2008 |
| WO | WO-2010/006098 | A2 | 1/2010 |

OTHER PUBLICATIONS

Supplementary European Search Report for EP 09 79 5153 dated Mar. 22, 2012.

International Search Report—PCT/US2008/051056.

Written Opinion—PCT/US2008/051056.

International Search Report—PCT/US2009/050004.

Written Opinion—PCT/US2009/050004.

Notice of Reason for Rejection for JP 2011-517590 dated Nov. 20, 2012, and English translation.

International Preliminary Report on Patentability—PCT/US2008/051056, Jul. 28, 2009, Graphic Packaging International, Inc.

International Preliminary Report on Patentability—PCT/US2009/050004, Jan. 11, 2011, Graphic Packaging International, Inc.

* cited by examiner

EVEN HEATING MICROWAVABLE CONTAINER

CROSS-REFERENCE TO RELATED APPLICATIONS

This application is a continuation of International Application No. PCT/US2008/051056, filed Jan. 15, 2008, which claims the benefit under 35 U.S.C. §119(e) of U.S. Provisional Application No. 60/881,781, filed Jan. 22, 2007, both of which are incorporated by reference herein in their entirety as though fully set forth herein.

TECHNICAL FIELD

The present invention relates to various structures, webs, blanks, tray, constructs, and methods for heating a food item, and particularly relates to various structures, webs, blanks, trays, constructs, and methods for heating a food item in a microwave oven.

BACKGROUND

Microwave ovens commonly are used as a convenient means of heating and/or reheating food items. However, when large food items are heated in a microwave oven, some portions of the food item tend to reach the desired final heating temperature too early in the heating cycle. As a result, such portions of the food item tend to become overheated, dry, and/or charred, while other portions remain underheated. Thus, there is a need for a package, container, or other construct that controls the rate of heating of the food item so that a substantial portion of the food item is not heated to the desired final heating temperature prematurely, such that the food item is suitably and substantially uniformly heated at the end of the heating cycle.

SUMMARY

The present invention generally is directed to various microwave energy interactive structures, webs, blanks, and trays, packages, containers, and other constructs (collectively "constructs") formed therefrom for heating a food item in a microwave oven. The various constructs include one or more features that generally promote even heating, prevent premature heating, and/or minimize overheating of a food item during the microwave heating cycle. As a result, the food item tends to have a better consistency and overall appearance.

More particularly, the various structures, blanks, and constructs of the invention include at least one diffusing element. Each diffusing element includes a microwave energy transparent area that circumscribes one or more microwave energy reflective elements. The reflective elements at least partially diffuse, scatter, and/or obstruct (collectively "diffuse") the microwave energy passing through the microwave energy transparent area. As a result, the rate of heating of various portions of a food item heated within the construct can be better controlled, thereby minimizing scorching, charring, or drying of the food item.

In one aspect, the structures, blanks, and constructs of the invention include at least one diffusing element circumscribed by a microwave energy shielding element.

In another aspect, the structures, blanks, and constructs of the invention include a microwave energy shielding element including at least one circumscribed microwave energy transparent area, at least one of which circumscribes one or more smaller microwave energy reflective elements.

In another aspect, a construct for heating a food item in a microwave oven comprises a base, a wall extending upwardly from the base, a microwave energy shielding element overlying at least a portion of the wall, and a microwave energy diffusing element circumscribed by the microwave energy shielding element. The microwave energy diffusing element includes a plurality of microwave energy reflective elements within a microwave energy transparent area.

The microwave energy transparent area may be formed in any suitable shape, for example, an ellipse, an oval, a circle, a triangle, a square, a rectangle, a symmetrical curvilinear shape, an asymmetrical curvilinear shape, a regular polygon, an irregular polygon, a regular shape, an irregular shape, and any combination thereof.

Likewise, each of the microwave energy reflective elements independently may have a shape independently selected from the group of shapes consisting of an ellipse, an oval, a circle, a triangle, a square, a rectangle, a symmetrical curvilinear shape, an asymmetrical curvilinear shape, a regular polygon, an irregular polygon, a regular shape, an irregular shape, and any combination thereof. In one example, at least some of the microwave energy reflective elements are substantially hexagonal in shape. In another example, some of the microwave energy reflective elements are substantially hexagonal in shape and some of the microwave energy reflective elements are partial hexagonal in shape.

The microwave energy reflective elements generally may be configured to reduce the intensity of the microwave energy passing through the microwave energy transparent area. In one example, the microwave energy reflective elements are arranged in a staggered configuration. In another example, the microwave energy reflective elements are arranged such that each microwave energy reflective element is spaced about the same distance from an adjacent microwave energy reflective element.

If desired, the construct may include a plurality of microwave energy diffusing elements. In one example, the wall is a first wall of a plurality of walls, the plurality of walls includes a first pair of opposed walls and a second pair of opposed walls, each wall of the first pair of walls includes three microwave energy diffusing elements, and each wall of the second pair of walls includes four microwave energy diffusing elements. In one variation, each wall of the plurality of walls has a height and a width, and the respective microwave energy diffusing elements are substantially evenly spaced along the height and width of the respective wall.

The microwave energy shielding element may extend substantially continuously from the wall and overlie a peripheral area of the base. The base also may include a microwave energy directing element to direct microwave energy toward the center of the base. The microwave energy directing element may comprise a plurality of metallic segments arranged in clusters that define a plurality of interconnected rings.

A blank for forming such a construct (or other variations thereof) may include a peripheral region substantially transparent to microwave energy, a medial region comprising a microwave energy shielding element, and a central region comprising a microwave energy directing element. The medial region may include a plurality of microwave energy diffusing elements circumscribed by the microwave energy shielding element, where each microwave energy diffusing element includes a plurality of microwave energy reflective elements within a microwave energy transparent area, such as those described above. In one example, the microwave energy shielding element has an inner edge and an outer edge, and the diffusing element is positioned substantially equidistant from the inner edge and the outer edge of the microwave energy shielding element.

Other features, aspects, and embodiments will be apparent from the following description and accompanying figures.

BRIEF DESCRIPTION OF THE DRAWINGS

The description refers to the accompanying drawings, in which like reference characters refer to like parts throughout the several views, and in which.

DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
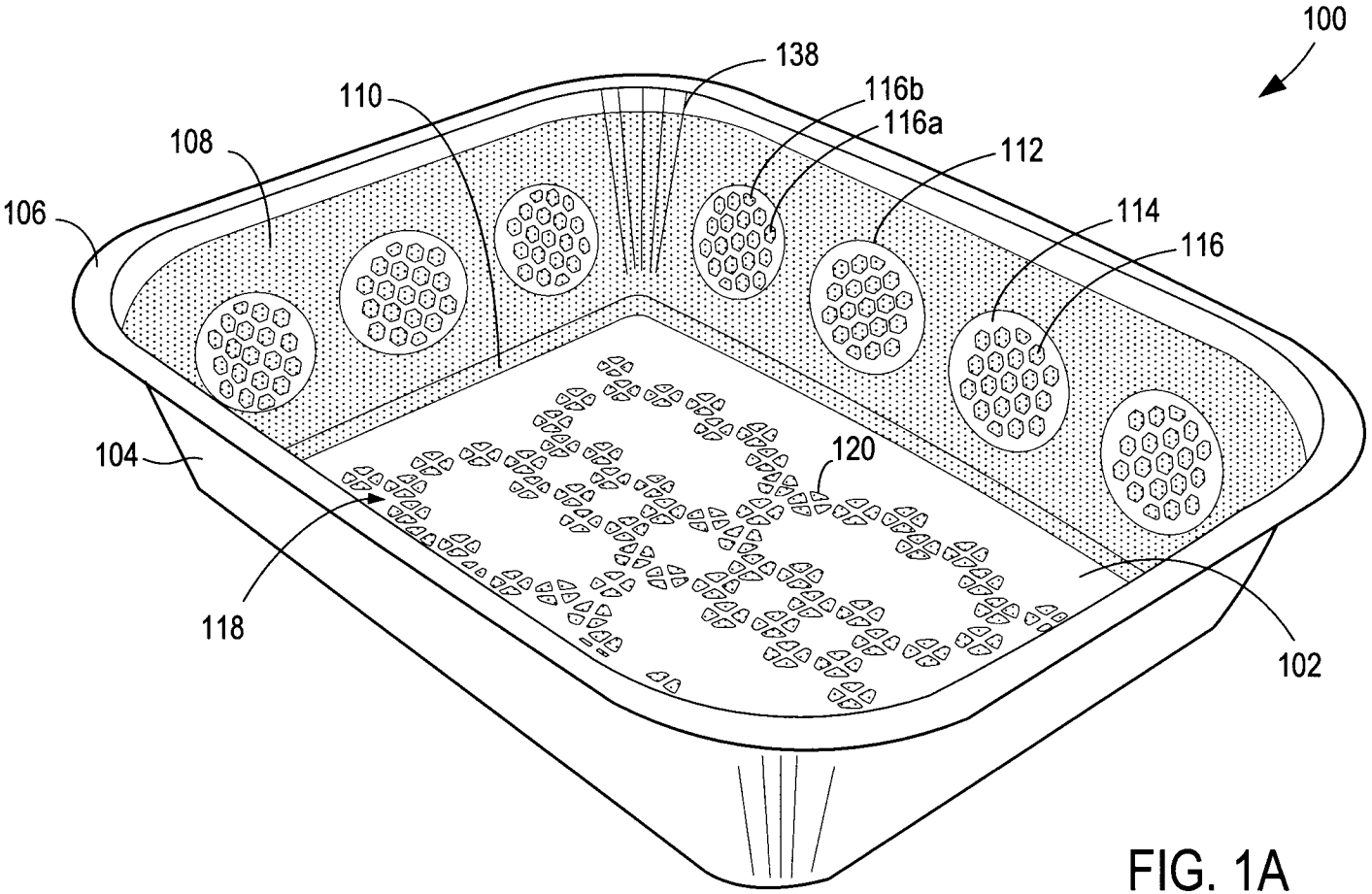
FIG. 1A schematically depicts an exemplary microwave heating construct including a plurality of microwave energy diffusing elements according to various aspects of the invention.

FIG. 1A schematically illustrates an exemplary construct (e.g., tray) 100 according to various aspects of the invention. The tray 100 generally includes a base 102 and a plurality of walls 104 extending substantially upwardly from the base 102. In this example, the tray 100 is substantially rectangular in shape with rounded corners and a somewhat flattened rim 106. However, other shapes are contemplated by the invention. In one example, the construct may be circular in shape (e.g., bowl-shaped). In such an example, the construct could be said to include a single wall.

Still viewing FIG. 1A, the tray 100 includes a microwave energy shielding element 108 (sometimes referred to as a "shielding element") (shown schematically by stippling) overlying, joined to, and/or defining at least a portion of the interior surface of the walls 104. However, it is contemplated that the shielding element may overlie, may be joined to, and/or may define at least a portion of the exterior surface of the walls 104. In this example, the microwave energy shielding element 108 extends substantially continuously from the walls 104 and overlies a peripheral area 110 of the base 102. However, other configurations are contemplated by the invention.

The tray 100 also includes a plurality of microwave energy diffusing elements 112 (sometimes referred to as "diffusing elements") circumscribed (i.e., surrounded) by the microwave energy shielding element 108. Each diffusing element 112 includes a microwave energy transparent area 114 (sometimes referred to as a "transparent area") through which microwave energy can pass freely. Each diffusing element 112 also includes a plurality of microwave energy reflective elements 116 (sometimes referred to as a "reflective elements") (shown schematically by stippling) disposed within and circumscribed by the respective microwave energy transparent area 114.

Each microwave energy reflective element 116 independently tends to reflect microwave energy in a manner similar to that of the shielding element 108. However, in use, microwave energy is channeled towards the diffusing elements 112 and the microwave energy reflective elements 116 work in concert to diffuse, scatter, and/or obstruct (collectively "diffuse") the microwave energy passing through the respective microwave energy transparent area 114. While not wishing to be bound by theory, such elements are believed to induce constructive and destructive interference of the microwave energy, thereby enlarging the heating volume and reducing the heating intensity to achieve gentler and more even heating of the food item. Thus, as a matter of clarity and to distinguish from the purpose and function of shielding element 108, such elements 116 are referred to as "microwave energy reflective elements" rather than "microwave energy shielding elements", unless otherwise noted.

It will be understood that the size, shape, number, type, and configuration of diffusing elements 112 may be adjusted as needed for each heating application. In this example, each microwave energy transparent area 114 is curvilinear in shape (i.e., consisting of or bounded by curved lines), generally resembling an ellipse having a major axis extending in a horizontal direction (i.e., in a direction extending along the length and width of the tray 100). In other examples, the major axis of an elliptical microwave energy transparent area 114 may extend in a vertical direction (i.e., in a direction extending along the height of the tray 100). In still other examples, the transparent area 114 may be shaped as an oval, circle, triangle, square, rectangle, any other symmetrical or asymmetrical curvilinear shape, any other regular or irregular polygon, any other regular or irregular shape, or any combination thereof.

Each diffusing element may have any suitable dimensions. Typically, each diffusing element may have a major linear dimension of from about 5 to about 50 mm. In each of various examples, each diffusing element independently may have a major linear dimension of from about 5 to about 10 mm, 10 to about 15 mm, from about 15 to about 20 mm, from about 20 to about 25 mm, from about 25 to about 30 mm, from about 30 to about 35 mm, from about 35 to about 40 mm, from about 40 to about 45 mm, or from about 45 to about 50 mm. However, numerous other dimensions and ranges are contemplated. In one particular example, the major linear dimension of the diffusing element is about 29 mm, as illustrated schematically in FIG. 1C.

Likewise, each of the microwave energy reflective elements 116 independently may have any suitable shape and size including, but not limited to, an ellipse, an oval, circle, triangle, square, rectangle, any other symmetrical or asymmetrical curvilinear shape, any other regular or irregular polygon, any other regular or irregular shape, or any combination thereof. In one example, at least some of the microwave energy reflective elements are substantially hexagonal in shape. In another example, some of the microwave energy reflective elements are substantially hexagonal in shape and some of the microwave energy reflective elements are partial hexagonal in shape (i.e., shaped as a hexagon that has been partially truncated or cropped). In the exemplary tray 100 of FIG. 1A, each diffusing element includes seventeen substantially hexagonal reflective elements (e.g., reflective element 116*a*) and two reflective elements that resemble partial hexagons (e.g., reflective element 116*b*), each of which is circumscribed by the respective microwave energy transparent area 114. However, other numbers, types, and combinations of microwave energy reflective elements are contemplated.

Each reflective element independently generally may have a major linear dimension of from about 1 to about 20 mm. In each of various examples, each reflective element independently generally may have a major linear dimension of from about 1 to about 2 mm, from about 2 to about 3 mm, from about 3 to about 4 mm, from about 4 to about 5 mm, from about 5 to about 6 mm, from about 6 to about 7 mm, from about 7 to about 8 mm, from about 8 to about 9 mm, from about 9 to about 10 mm, from about 10 to about 11 mm, from about 11 to about 12 mm, from about 12 to about 13 mm, from about 13 to about 14 mm, from about 14 to about 15 mm, from about 15 to about 16 mm, from about 16 to about 17 mm, from about 17 to about 18 mm, from about 18 to about 19 mm, or from about 19 to about 20 mm. In each of other examples, each reflective element independently generally may have a major linear dimension of from about 1 mm to about 10 mm, from about 2 to about 8 mm, or from about 3 to about 5 mm. However, numerous other dimensions and ranges are contemplated. In one particular example, the major linear dimension of the reflective element is about 4.2 mm, as illustrated schematically in FIG. 1C. In another example, the diffusing element includes a plurality of reflective elements, at least one of which has a diameter up to about one-half of the major dimension (e.g. diameter) of the microwave energy transparent area.

The microwave energy reflective elements 116 may be arranged in any suitable manner within the respective microwave energy transparent area 114. In one example, the microwave energy reflective elements 116 are arranged in a nested or staggered configuration, as shown schematically in FIGS. 1A-1C. In another example, the microwave energy reflective elements are arranged in a tiled configuration. However, other symmetrical and asymmetrical arrangements are within the scope of the invention.

The spacing between the microwave energy reflective elements 116 also may vary for each application. In general, the microwave energy reflective elements 116 are configured to reduce the intensity of the microwave energy passing through the respective microwave energy transparent area 114. In one example, the microwave energy reflective elements 116 are arranged such that each microwave energy reflective element is spaced about the same distance from an adjacent microwave energy reflective element. However, non-uniform placement also may be suitable for some applications.

The spacing between adjacent reflective elements generally may be from about 0.5 mm to about 15 mm. In each of various examples, the spacing between adjacent reflective elements independently may be from about 0.5 to about 1 mm, from about 1 to about 2 mm, from about 2 to about 3 mm, from about 3 to about 4 mm, from about 4 to about 5 mm, from about 5 to about 6 mm, from about 6 to about 7 mm, from about 7 to about 8 mm, from about 8 to about 9 mm, from about 9 to about 10 mm, from about 10 to about 11 mm, from about 11 to about 12 mm, from about 12 to about 13 mm, from about 13 to about 14 mm, or from about 14 to about 15 mm. In each of various other examples, the spacing between adjacent reflective elements independently may be from about from about 0.5 to about 10 mm, from about 1 to about 5 mm, or from about 1.5 to about 3 mm. However, numerous other ranges are contemplated. In one particular example, the gap between adjacent reflective elements is about 1.8 mm, as illustrated schematically in FIG. 1C.

Any number of diffusing elements 112 may be used in accordance with the invention. In some heating applications, only one diffusing element may be needed. In one such example, the diffusing element includes one reflective element and the distance or gap between the reflective element and the periphery of the microwave transparent area is at least about 0.5 mm. In other applications, two, three, four, or more may be needed to bring about the desired result. In the example shown in FIG. 1A, the tray 100 includes a first pair of opposed walls 104, each of which includes four diffusing elements 112, and a second pair of opposed walls 104, each of which includes three diffusing elements 112. Each diffusing element 112 in this example is substantially the same as each other diffusing element 112. However, it is contemplated that the diffusing elements in a particular construct may differ from one another. Additionally, while the diffusing elements are substantially evenly spaced along the height and width of each respective wall, it will be understood that other positions may be suitable for use with the invention.

Still viewing FIG. 1A, the tray 100 may include a microwave energy directing element 118 overlying the base 102. The microwave energy directing element 118 includes a plurality of metallic segments 120 (shown schematically by stippling) arranged in clusters in a lattice-like configuration that define a plurality of interconnected rings. Each cluster includes four substantially identical segments 120, and the clusters are arranged to form four larger rings and five smaller rings. In this example, the microwave energy directing element 118 is configured to direct microwave energy toward the center of the base 102. However, other microwave energy directing elements may be used in accordance with the invention.

In use, a food item (not shown) within the tray 100 is placed into a microwave oven (not shown). When exposed to microwave energy, the shielding element 108 generally prevents the sides of the food item from overheating, drying, or scorching. Instead, microwave energy is channeled towards the diffusing elements 112. The microwave energy reflective elements 116 in each diffusing element 112 collectively diffuse the microwave energy passing through the respective microwave energy transparent area 114. The rate of heating of the food item is reduced in the shielded areas, so the temperature of the food item in the shielded areas does not reach the desired heating temperature until later in the heating cycle. Thus, such areas that would otherwise tend to be prone to breaking down, overheating, drying, or scorching are properly heated. At the same time, the microwave energy directing element 118 transmits microwave energy toward the central portion of the bottom of the food item (not shown), which often is otherwise underheated. As a result, the food item generally is heated more evenly and features a more acceptable appearance and quality.

If desired, the tray 100 may be provided with a cover or lid (not shown) that may include one or more microwave energy interactive elements that further alter or enhance the effect of microwave energy on the food item. Numerous covers are contemplated hereby.

Figure 1B:
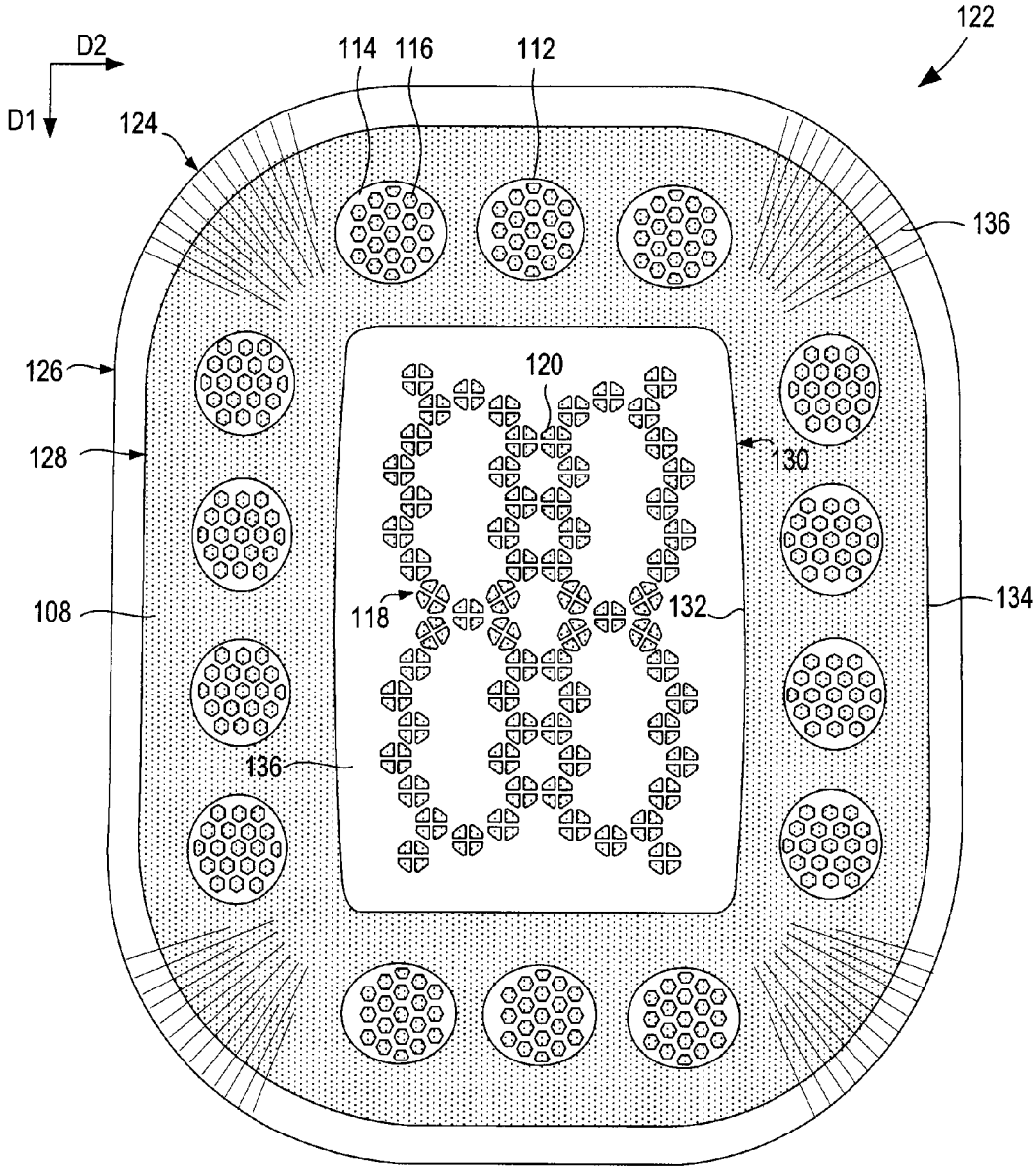
FIG. 1B schematically depicts an exemplary blank that may be used to form the construct of FIG. 1A.

FIG. 1B illustrates an exemplary blank 122 that may be used to form the construct 100 of FIG. 1A. The blank 122 is substantially rectangular in shape with rounded corners 124. However, other shapes are within the scope of the invention. The blank generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the structure is manufactured or erected into a construct.

The blank 122 generally includes a pattern or arrangement of microwave energy interactive areas or elements and microwave energy transparent areas or elements arranged to form a peripheral region 126, a medial region 128, and a central region 130. The peripheral region 126 is substantially transparent to microwave energy. The medial region 128 is generally a microwave energy shielding area defined by an inner edge 132 and an outer edge 134 of the microwave energy shielding element 108. The diffusing elements 112 lie within the medial region 128 circumscribed by the microwave energy shielding element 108, substantially centered between the inner edge 132 and outer edge 134 of the microwave energy shielding element 108. The microwave energy directing element 118 lies substantially centered within a microwave energy transparent area 136 that defines the central region 130.

The blank 122 may be formed into a tray 100 or other construct in any suitable manner including, but not limited to, various thermal, mechanical, or thermomechanical techniques or devices, or any combination of such techniques and/or devices. When the blank 122 is formed into the tray 100 of FIG. 1A, the peripheral region 126 of the blank 122 forms at least a portion of the rim 106 of the tray 100 and may form an uppermost portion of the walls 104. The medial region 128 forms at least a portion of the walls 104 and the peripheral portion 110 of the base 102. The central region 130 forms at least a portion of the base 102. If desired, the blank may include a plurality of creases 138 or other lines of disruption that extend radially inward from the corners 124 of the blank 122 to facilitate formation of the corners of the tray 100.

Numerous materials may be suitable for use in forming the various blanks and constructs (e.g. trays) of the invention, provided that the materials are resistant to softening, scorching, combusting, or degrading at typical microwave oven heating temperatures, for example, from about 250° F. to about 425° F. Such materials may include microwave energy interactive materials and microwave energy transparent or inactive materials.

The microwave energy interactive material used to form the various microwave energy interactive elements may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric vehicle or other suitable matrix or binder, and may include flakes of an electroconductive metal, for example, aluminum.

The microwave energy interactive material may be used to form one or more microwave energy interactive elements or features that alter the effect of microwave energy during the heating or cooking of the food item. Such elements or features may shield a particular area of the food item from microwave energy, may direct microwave energy towards or away from a particular area of the food item, or may promote browning and/or crisping of a particular area of the food item. In doing so, the various elements reflect, absorb, or transmit microwave energy in various proportions to bring about a desired heating, browning, and/or crisping result.

Figure 1C:
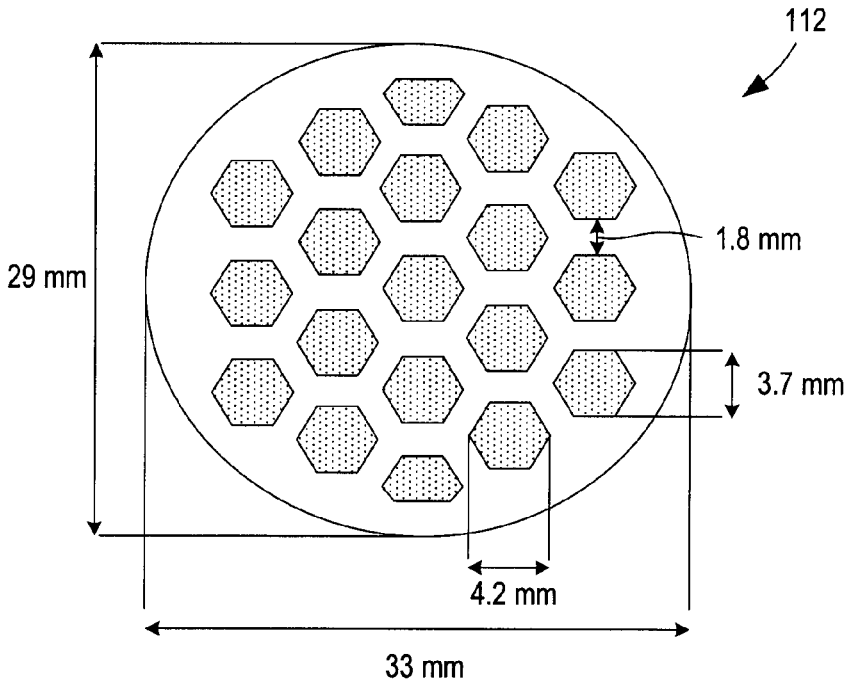
FIG. 1C schematically depicts an enlarged view of a microwave energy diffusing element used in the exemplary tray of FIG. 1A and exemplary blank of FIG. 1B, with approximate exemplary dimensions.

In the example illustrated schematically in FIGS. 1A-1C, the microwave energy shielding element 108, the microwave energy reflective elements 116, and the segments 120 of the microwave energy diffusing element 118 may comprise a foil or high optical density evaporated material having a thickness sufficient to reflect a substantial portion of impinging microwave energy. Typically, such elements are formed from a conductive, reflective metal or metal alloy, for example, aluminum, copper, or stainless steel, in the form of a solid "patch" generally having a thickness of from about 0.000285 inches to about 0.05 inches, for example, from about 0.0003 inches to about 0.03 inches. Other such elements may have a thickness of from about 0.00035 inches to about 0.020 inches, for example, 0.016 inches.

Microwave energy reflecting elements may be configured in various ways, depending on the particular application for which the element is used. Larger microwave energy reflecting elements, for example, shielding element 108, may be used where the food item is prone to scorching or drying out during heating. Smaller microwave energy reflecting elements, for example, reflective elements 116, may be used to diffuse or lessen the intensity of microwave energy. A plurality of smaller microwave energy reflecting elements, for example, elements or segments 120, also may be arranged to form a microwave energy directing element, for example, microwave energy directing element 118, to direct microwave energy to specific areas of the food item, for example, the center of the bottom of the food item. If desired, the loops may be of a length that causes microwave energy to resonate, thereby enhancing the distribution effect. While one particular microwave energy distributing element is illustrated herein, it will be understood that numerous other patterns and configuration of segments are contemplated hereby. Examples of other microwave energy distributing elements are described in U.S. Pat. Nos. 6,204,492, 6,433,322, 6,552,315, and 6,677,563, each of which is incorporated by reference in its entirety.

Although particular examples of microwave energy interactive elements are illustrated in FIGS. 1A-1D, it will be understood that other microwave energy interactive elements (not shown) may be used in accordance with the invention. For example, a construct or blank may include a thin layer of microwave interactive material (generally less than about 100 angstroms in thickness, for example, from about 60 to about 100 angstroms in thickness) that tends to absorb at least a portion of impinging microwave energy and convert it to thermal energy (i.e., heat) at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor".

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture" (e.g., microwave energy transparent areas 114). A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item. As such, physical apertures may be referred to as "venting apertures".

Where a susceptor is used, it may be beneficial to create one or more discontinuities or inactive regions to prevent overheating or charring of the construct. Such areas may be designed to be microwave energy transparent, for example, by forming such areas without a microwave energy interactive material, by removing any microwave energy interactive material that has been applied, or by deactivating the microwave energy interactive material such areas. Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment.

If desired, one or more of the various microwave energy interactive elements may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to as "microwave interactive webs".

The substrate typically comprises an electrical insulator, for example, a polymer film or other polymeric material. As used herein, the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 66, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 66, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 cc/m$^2$/day. In one aspect, the barrier film has an OTR of less than about 10 cc/m$^2$/day. In another aspect, the barrier film has an OTR of less than about 1 cc/m$^2$/day. In still another aspect, the barrier film has an OTR of less than about 0.5 cc/m$^2$/day. In yet another aspect, the barrier film has an OTR of less than about 0.1 cc/m$^2$/day.

The barrier film may have a water vapor transmission rate (WVTR) of less than about 100 g/m$^2$/day as measured using ASTM F1249. In one aspect, the barrier film has a WVTR of less than about 50 g/m$^2$/day. In another aspect, the barrier film has a WVTR of less than about 15 g/m$^2$/day. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. For example, at least the side of the support that will form an exterior surface of a construct erected therefrom may be coated with a clay coating or other base coating. The coating may then be printed over with product advertising, images, price coding, any other information or indicia, or any combination thereof. The blank or construct then may be overcoated with a varnish to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 66, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006, both of which are incorporated herein by reference in their entirety. Additionally, the blanks or other constructs may include graphics or indicia printed thereon.

It will be understood that with some combinations of elements and materials, the microwave interactive element may have a color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, where the microwave energy interactive element is silver or grey in color, a silver or grey toned adhesive may be used to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

As mentioned above, the blank 122 may be formed into the tray 100 or other construct in any suitable manner including, but not limited to, various thermal, mechanical, or thermomechanical techniques or devices, or any combination of such techniques and/or devices. As also mentioned above, the microwave energy interactive elements 108, 116, 118 may be part of a microwave interactive web (e.g., the microwave energy interactive elements 108, 116, 118 may be carried by a polymer film). In this regard and in another example, the tray 100 may be formed by mounting such a microwave interactive web (e.g., which includes a polymer film that carries the microwave energy interactive element 108, 116, 118) within, or otherwise to, a previously formed container (not shown), such as, but not limited to, a previously formed container (e.g., tray) formed from a polymer or polymeric material. The entire disclosure of U.S. patent application Ser. No. 11/715,556, filed Mar. 8, 2007, is incorporated herein by reference. Also, FIG. 1B of the present application can be characterized as being at least substantially illustrative of an isolated plan view of such a microwave interactive web (e.g., which includes a polymer film that carries the microwave energy interactive element 108, 116, 118) that is in a flat configuration prior to mounting to the previously formed container, although such a microwave interactive web in its flat configuration may typically not include the creases 138. Generally described, the tray 100 may be formed in any acceptable manner.

The present invention may be understood further by way of the following examples, which are not to be construed as limiting in any manner.

Examples 1-4

Nestle Stouffer's family size lasagnas with meat sauce having a mass of about 38 oz. were heated to determine the heating profile in various microwave heating trays in various microwave ovens. Each microwave oven included a glass turntable.

Example 1

The baseline heating characteristics of the lasagna were determined by heating each lasagna in the coextruded polyethylene terephthalate (CPET) tray provided in the package. The tray did not include any microwave energy interactive elements. Each lasagna was heated for a total of about 31 minutes, 14 minutes at 100% power and 17 minutes at 50% power, according to the heating instructions provided with the lasagna. The results are presented in Table 1.

TABLE 1

| Microwave Oven | Minimum Temp. (° F.) | Maximum Temp. (° F.) | Average Temp. (° F.) | Standard Deviation (° F.) |
|---|---|---|---|---|
| 900 W GE | 126 | 164 | 151 | 10 |
| 900 W Sanyo | 170 | 190 | 184 | 4 |
| 1100 W LG | 159 | 183 | 173 | 6 |
| 1110 W Panasonic | 146 | 171 | 164 | 6 |

In general, some burning of the cheese and sauce occurred near the edges of the lasagna. One lasagna exhibited an extremely overcooked top surface. The texture of the bottom noodle was acceptable.

Example 2

The heating characteristics of the lasagna again were determined by heating each lasagna in the CPET tray provided in the package as set forth in Example 1, except that the lasagna was heated at full power for the entire heating cycle. The results are presented in Table 2.

TABLE 2

| Microwave Oven | Heating time (min) | Minimum Temp. (° F.) | Maximum Temp. (° F.) | Average Temp. (° F.) | Standard Deviation (° F.) |
|---|---|---|---|---|---|
| 900 W GE | 21 | 121 | 155 | 139 | 12 |
| 900 W Sanyo | 19 | 138 | 195 | 178 | 16 |
| 1100 W LG | 20 | 134 | 200 | 184 | 12 |
| 1110 W Panasonic | 18 | 145 | 177 | 167 | 8 |

In general, the top surface of each lasagna was overcooked with hardened areas near the edges. A small amount of drying out of the bottom noodle was observed with one of the higher wattage ovens.

Example 3

The heating characteristics of the lasagna were evaluated using the microwave energy interactive tray illustrated in FIGS. 1A and 1C. Each lasagna was heated at full power during the entire heating cycle. The results are presented in Table 3.

TABLE 3

| Microwave Oven | Heating time (min) | Minimum Temp. (° F.) | Maximum Temp. (° F.) | Average Temp. (° F.) | Standard Deviation (° F.) |
|---|---|---|---|---|---|
| 900 W GE | 20 | 155 | 183 | 170 | 9 |
| 900 W Sanyo | 19 | 160 | 193 | 182 | 9 |
| 1100 W LG | 16 | 160 | 191 | 174 | 10 |
| 1110 W Panasonic | 18 | 144 | 194 | 170 | 14 |

In general, there was some slight overcooking of the top surface in the center of the lasagna. The cheese and sauce was heated along the edges, without any burning or scorching. The bottom noodle exhibited some minor drying. The texture of the sauce and noodles on the interior of the lasagna was good.

Example 4

Figure 1D:
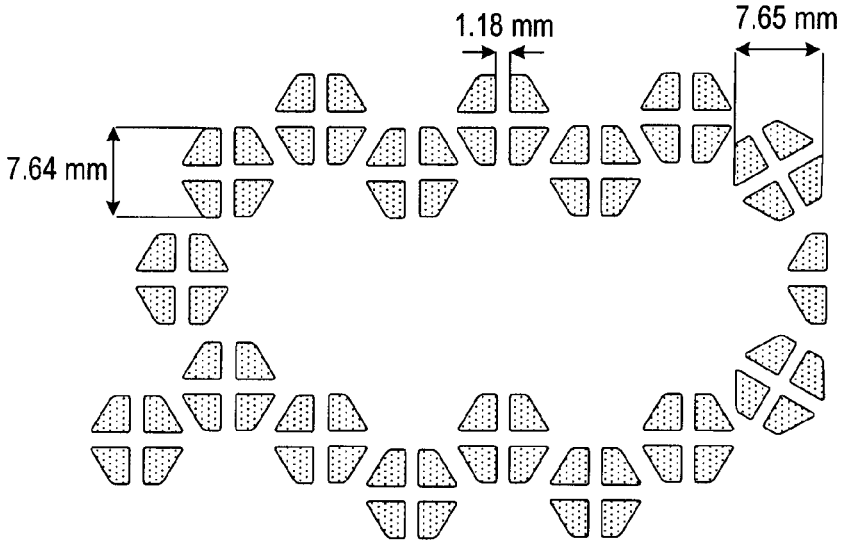
FIG. 1D schematically depicts a partial, enlarged view of a microwave energy directing element used in the exemplary tray of FIG. 1A and exemplary blank of FIG. 1B, with approximate exemplary dimensions.
Figure 2:
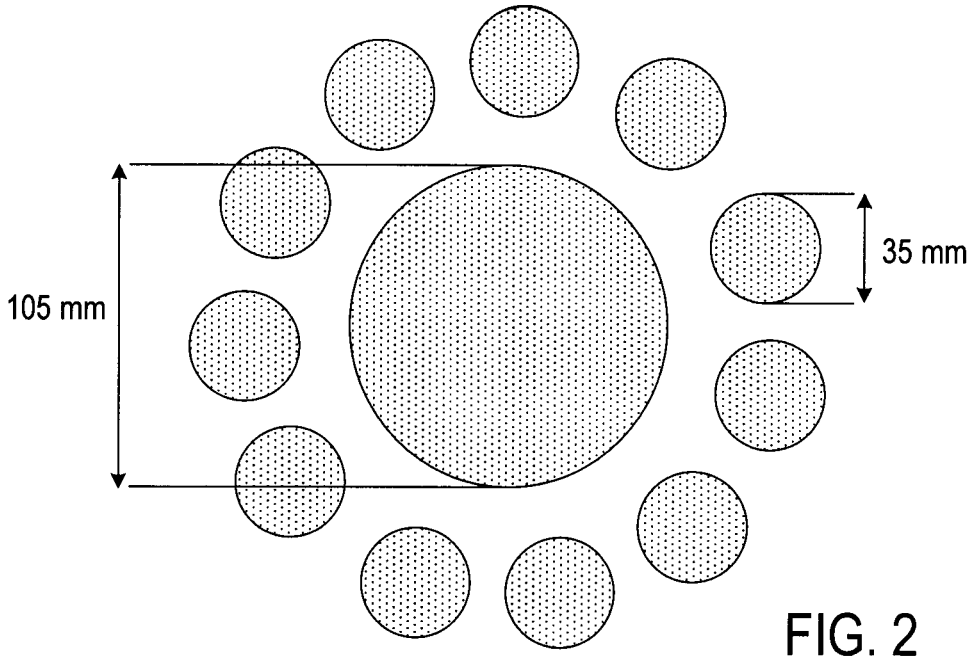
FIG. 2 schematically depicts an exemplary arrangement of microwave energy shielding elements that may be used to form a microwave energy interactive cover or lid in accordance with various aspects of the invention, with approximate dimensions.

The heating characteristics of the lasagna were evaluated using the microwave energy interactive tray illustrated schematically in FIG. 1A, with the dimensions provided schematically in FIGS. 1C and 1D. Prior to heating, the lasagna was covered with a microwave energy interactive cover comprising a plurality of shielding elements including a substantially centrally located shielding element and several additional shielding elements positioned around the central shielding element, as represented schematically in FIG. 2. The shielding elements of FIG. 2 are like those discussed above, except for variations noted and variations that will be apparent to those of skill in the art. Each lasagna was heated at full power during the entire heating cycle. The results are presented in Table 4.

TABLE 4

| Microwave Oven | Heating time (min) | Minimum Temp. (° F.) | Maximum Temp. (° F.) | Average Temp. (° F.) | Standard Deviation (° F.) |
|---|---|---|---|---|---|
| 900 W GE | 21 | 160 | 189 | 172 | 9 |
| 900 W Sanyo | 18 | 158 | 179 | 169 | 6 |
| 1100 W LG | 21 | 152 | 198 | 185 | 11 |
| 1110 W Panasonic | 18 | 161 | 186 | 174 | 6 |

In general, the appearance of the top surface and edges of each of the lasagnas was excellent, as was the internal texture of the sauce and noodles. Some minor drying of the bottom noodle was observed.

Example 5

Figure 3:
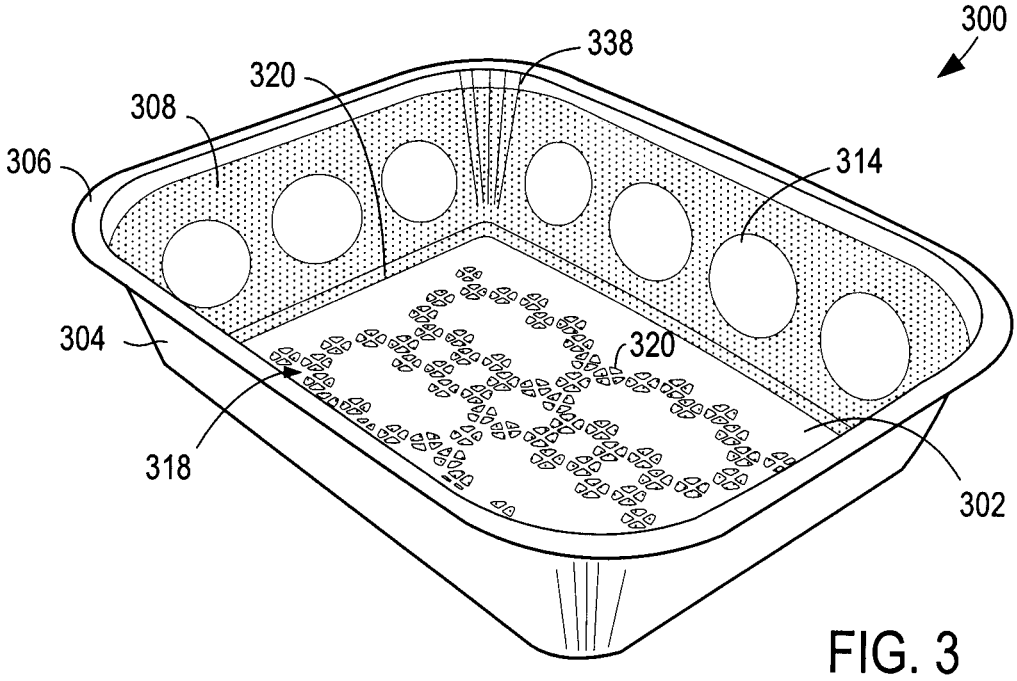
FIG. 3 schematically depicts an exemplary comparative tray without diffusing elements for comparison with a tray according to the invention.

Nestle Stouffer's family size lasagnas with meat sauce having a mass of about 38 oz. were heated in various microwave ovens to compare the performance of a tray according to the invention, illustrated schematically in FIGS. 1A, 1C, and 1D with a similar tray without diffusing elements, as illustrated schematically in FIG. 3. The tray 300 of FIG. 3 includes some features that are similar to tray 100 shown in FIG. 1A, except for variations noted and variations that will be understood by those of skill in the art. For simplicity, the reference numerals of similar features are preceded in the figures with a "3" instead of a "1". Most notably, the tray 300 includes transparent areas 314 instead of the diffusing elements 112 of FIG. 1A.

The lasagnas were heated in two different microwave ovens as follows: (1) a Sharp Model R316FS having a stated power of 1000 W and a measured output power of 717 W, for about 19-20 min., and (2) an Amana Model ME96T having a stated power of 800 W and a measured output power of 612 W for about 22 min. Each microwave oven included a glass turntable. The lasagnas were heated uncovered in each oven for the specified amount of time and allowed to stand for about 5 minutes. Each lasagna was evaluated for topping appearance, level of seepage of the sauce from underneath the top noodle, and sauce color.

In general, for both of the two microwave ovens, the lasagnas heated in trays with the hexagonal diffusing elements had a better appearance with less of the sauce bubbling out from beneath the top noodle. In some instances, the sauce had a slightly more red tone, as compared with the more orange-colored sauce in the lasagnas cooked in trays without the diffusing elements.

While various examples of constructs are provided herein, it will be understood that any configuration of components may be used as needed or desired. The construct may be flexible, semi-rigid, rigid, or may include a variety of components having different degrees of flexibility. Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated by the invention.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

It is intended that all matter contained in the above description or shown in the accompanying drawings shall be interpreted as illustrative only and not limiting. For example, various elements discussed with reference to the various embodiments may be interchanged to create entirely new embodiments coming within the scope of the present invention. Furthermore, changes in detail or structure may be made without departing from the spirit of the invention. Thus, the detailed description set forth herein is not intended nor is to be construed to limit the present invention or otherwise to exclude any such other embodiments, adaptations, variations, modifications, and equivalent arrangements of the present invention. Rather, the description is only illustrative and exemplary of the present invention and is made merely for purposes of providing a full and enabling disclosure of the present invention and to provide the best mode contemplated by the inventor or inventors of carrying out the invention.

Thus, while the present invention has been discussed above with reference to exemplary embodiments, various additions, modifications and changes can be made thereto without departing from the spirit and scope of the invention as set forth in the following claims.

What is claimed is:

1. A microwave heating construct, comprising:

a base; and an upstanding wall, wherein the wall comprises a microwave energy shielding element, and a plurality of microwave energy diffuser elements, wherein each of the microwave energy diffuser elements comprises a microwave energy transparent area circumscribed by the microwave energy shielding element, and a plurality of microwave energy reflective elements spaced apart from one another and positioned in the microwave energy transparent area, wherein for each of the microwave energy diffuser elements, the microwave energy transparent area of the microwave energy diffuser element is contiguous with and surrounds each of the microwave energy reflective elements of the microwave energy diffuser element.

2. The construct of claim 1, wherein the microwave energy transparent areas and the microwave energy reflective elements each have a shape independently selected from the group of shapes consisting of a regular shape and an irregular shape.

3. The construct of claim 1, wherein the microwave energy transparent areas are substantially elliptical in shape.

4. The construct of claim 1, wherein the microwave energy reflective elements each independently have a hexagonal shape or a partial hexagonal shape.

5. The construct of claim 1, wherein for at least one of the microwave energy diffuser elements: the microwave energy reflective elements of the at least one microwave energy diffuser element are arranged in a staggered configuration within the microwave energy transparent area of the at least one microwave energy diffuser element.

6. The construct of claim 1, wherein for at least one of the microwave energy diffuser elements: the microwave energy reflective elements of the at least one microwave energy diffuser element are spaced a distance of from about 1 to about 5 mm from one another.

7. The construct of claim 1, wherein for at least one of the microwave energy diffuser elements: the microwave energy reflective elements of the at least one microwave energy diffuser element are arranged so that each microwave energy reflective element is spaced about the same distance from an adjacent microwave energy reflective element.

8. The construct of claim 1, wherein for each of the microwave energy diffuser elements: the microwave energy reflective elements of the microwave energy diffuser element are configured to be operative for decreasing the intensity of microwave energy passing through the microwave energy transparent area of the microwave energy diffuser element.

9. The construct of claim 1, wherein the microwave energy shielding element extends substantially continuously from the wall onto a peripheral margin of the base.

10. The construct of claim 1, wherein the base includes a plurality of metallic segments arranged to define a plurality of interconnected rings.

11. The construct of claim 10, wherein the plurality of metallic segments arranged to define the plurality of interconnected rings is operative for directing microwave energy toward a center of the base.

12. A microwave heating construct, comprising:

a base; and a plurality of walls, wherein the walls comprise a substrate, a microwave energy shielding element mounted to the substrate and comprising a metallic foil patch operative for reflecting microwave energy, wherein the metallic foil patch includes a plurality of apertures, and each aperture defines a microwave energy transparent area surrounded by the metallic foil, and a plurality of microwave energy diffuser elements, wherein each of the microwave energy diffuser elements comprises the microwave energy transparent area defined by a respective aperture of the plurality of apertures in the metallic foil patch, and a plurality of metallic foil elements mounted to the substrate, wherein the metallic foil elements are spaced apart from one another and positioned in the microwave energy transparent area of the microwave energy diffuser element, wherein for each of the microwave energy diffuser elements, the microwave energy transparent area of the microwave energy diffuser element is contiguous with and circumscribes each of the metallic foil elements of the microwave energy diffuser element.

13. The construct of claim 12, wherein the metallic foil elements have a hexagonal shape, a partial hexagonal shape, or any combination thereof.

14. The construct of claim 12, wherein for at least one of the microwave energy diffuser elements: the metallic foil elements of the at least one microwave energy diffuser element are spaced about 1 to about 5 mm from one another within the microwave energy transparent area of the least one of the microwave energy diffuser elements.

15. The construct of claim 12, wherein the plurality of walls includes a first pair of walls opposite one another and a second pair of walls opposite one another, each wall of the first pair of walls includes three apertures of the plurality of apertures, and each wall of the second pair of walls includes four apertures of the plurality of apertures.

16. The construct of claim 12, wherein the plurality of walls each independently have a height and a width, and the apertures are substantially evenly spaced along the height and width of the respective wall.

17. The construct of claim 12, wherein the metallic foil patch extends substantially continuously from the plurality of walls onto a peripheral area of the base.

18. The construct of claim 12, wherein the base includes a plurality of metallic segments arranged as a plurality of interconnected rings.

19. The construct of claim 18, wherein the plurality of interconnected rings is operative for directing microwave energy toward a center of the base.

20. The construct of claim 12, further comprising a susceptor.

21. The construct of claim 12, wherein the substrate comprises paperboard.

22. A blank for forming a microwave heating construct, the blank comprising:

a peripheral region being substantially transparent to microwave energy;

a medial region bounded by the peripheral region; and a central region bounded by the medial region, wherein the medial region comprises a microwave energy shielding element comprising a metallic foil patch operative for reflecting microwave energy, wherein the metallic foil patch circumscribes apertures that define microwave energy transparent areas, and a plurality of microwave energy diffuser elements, wherein each of the microwave energy diffuser elements comprises the microwave energy transparent area defined by a respective aperture of the apertures circumscribed by the metallic foil patch, and a plurality of metallic foil elements spaced apart from one another and positioned in the microwave energy transparent area of the microwave energy diffuser element, wherein for each of the microwave energy diffuser elements, the microwave energy transparent area of the microwave energy diffuser element is contiguous with and extends around each of the metallic foil elements of the microwave energy diffuser element.

23. The blank of claim 22, wherein the microwave energy transparent areas and the metallic foil elements each have a shape independently selected from the group of shapes consisting of a regular shape and an irregular shape.

24. The blank of claim 22, wherein the microwave energy transparent areas are substantially elliptical in shape.

25. The blank of claim 22, wherein the microwave energy reflective elements are each independently shaped as a hexagon or a truncated hexagon.

26. The blank of claim 22, wherein for at least one of the microwave energy diffuser elements: the metallic foil elements of the at least one microwave energy diffuser element are arranged in a staggered configuration within the microwave energy transparent area of the at least one microwave energy diffuser element.

27. The blank of claim 22, wherein for at least one of the microwave energy diffuser elements: the metallic foil elements of the at least one microwave energy diffuser element are spaced a distance of from about 1 to about 5 mm from one another.

28. The blank of claim 22, wherein for at least one of the microwave energy diffuser elements: the metallic foil elements of the at least one microwave energy diffuser element are arranged so that each metallic foil element is spaced about the same distance from an adjacent metallic foil element.

29. The blank of claim 22, wherein for each of the microwave energy diffuser elements: the metallic foil elements of the microwave energy diffuser element are for reducing the intensity of microwave energy passing through the microwave energy transparent area of the microwave energy diffuser element.

30. The blank of claim 22, wherein the metallic foil patch has an inner edge and an outer edge, and the microwave energy transparent areas are each positioned substantially equidistant from the inner edge and the outer edge of the metallic foil patch.

31. The blank of claim 22, wherein the central region comprises a microwave energy directing element including a plurality of metallic segments that define a plurality of interconnected rings.

32. The blank of claim 22, further comprising a susceptor.

33. The blank of claim 22, wherein the substrate comprises paperboard.

* * * * *